US008831481B2

(12) United States Patent
Tazawa et al.

(10) Patent No.: US 8,831,481 B2
(45) Date of Patent: Sep. 9, 2014

(54) ELECTROPHOTOGRAPHIC APPARATUS HAVING HAVING TEMPERATURE DEPENDENT PHOTOSENSITIVE MEMBER

(71) Applicant: Canon Kabushiki Kaisha, Tokyo (JP)

(72) Inventors: Daisuke Tazawa, Yokohama (JP); Tomohito Ozawa, Mishima (JP); Takanori Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/625,973

(22) Filed: Sep. 25, 2012

(65) Prior Publication Data

US 2013/0077987 A1 Mar. 28, 2013

(30) Foreign Application Priority Data

Sep. 28, 2011 (JP) ..... 2011-212632
Sep. 19, 2012 (JP) ..... 2012-206001

(51) Int. Cl.
*G03G 15/00* (2006.01)
*G03G 21/20* (2006.01)

(52) U.S. Cl.
USPC ..... 399/159; 399/92

(58) Field of Classification Search
CPC G03G 15/75; G03G 15/5033; G03G 15/5037
USPC ..... 399/159, 92
See application file for complete search history.

(56) References Cited

U.S. PATENT DOCUMENTS 8,185,017 B2 * 5/2012 Yamashita et al. ..... 399/159
2005/0169660 A1 8/2005 Yamada et al.
2007/0154239 A1 * 7/2007 Fukunaga et al. ..... 399/159
2007/0177897 A1 * 8/2007 Ishii ..... 399/159
2007/0201895 A1 * 8/2007 Nakano ..... 399/96
2007/0201896 A1 * 8/2007 Nakano ..... 399/96
2007/0231005 A1 * 10/2007 Fukunaga ..... 399/159
2011/0123215 A1 * 5/2011 Nishimura et al. ..... 399/92

FOREIGN PATENT DOCUMENTS

JP 7-209930 A 8/1995

OTHER PUBLICATIONS

European Search Report dated Apr. 22, 2014, in related European Patent Application No. 12186295.7.

* cited by examiner

*Primary Examiner* — G. M. Hyder
(74) *Attorney, Agent, or Firm* — Fitzpatrick, Cella, Harper & Scinto

(57) ABSTRACT

An electrophotographic apparatus does not have a unit for maintaining a uniform surface temperature of an electrophotographic photosensitive member through its surface. The electrophotographic photosensitive member has temperature dependent characteristics and is equally divided into two regions in a cylindrical shaft direction such that absolute values of the temperature dependence of the photosensitive-member characteristics in the two regions are not the same. The electrophotographic photosensitive member is arranged so that when, among the two regions, a region which has a smaller absolute value of the temperature dependence of the photosensitive-member characteristics is defined as a first region, and a region which has a larger absolute value of the temperature dependence of the photosensitive-member characteristics is defined as a second region. The change of the surface temperature of the first region becomes larger than the change of the surface temperature of the second region when an image is formed by the electrophotographic apparatus.

6 Claims, 8 Drawing Sheets

ELECTROPHOTOGRAPHIC APPARATUS HAVING HAVING TEMPERATURE DEPENDENT PHOTOSENSITIVE MEMBER

BACKGROUND OF THE INVENTION

1. Field of the Invention

The present invention relates to an electrophotographic apparatus.

2. Description of the Related Art

An electrophotographic apparatus is widely used, for instance, for a copying machine, a facsimile and a printer. In addition, as an electrophotographic photosensitive member which is used for the electrophotographic apparatus, an electrophotographic photosensitive member having a photoconductive layer (photosensitive layer) formed from amorphous silicon thereon (amorphous-silicon electrophotographic photosensitive member) is well known.

FIG. 2 is a view illustrating an example of a conventional electrophotographic apparatus having a heater for an electrophotographic photosensitive member.

In the electrophotographic apparatus illustrated in FIG. 2, an electrophotographic photosensitive member 2001 has a heater 2010 for an electrophotographic photosensitive member installed therein, and the heater controls the surface temperature of the electrophotographic photosensitive member 2001.

In FIG. 2, the surface of the electrophotographic photosensitive member 2001 which is rotationally driven toward the direction of the arrow is electrostatically charged by a charging device 2002. The charging potential of the surface of the electrophotographic photosensitive member 2001 is adjusted by an electric current value which is passed to a charging wire 2011 in the charging device 2002. Subsequently, the surface of the electrophotographic photosensitive member 2001 is irradiated with an image exposure beam 2003 emitted from an image exposure device (not shown), and an electrostatic latent image is formed on the surface thereof. Then, the electrostatic latent image which has been formed on the surface of the electrophotographic photosensitive member 2001 is developed by a toner which is supplied from a developing device 2004, and a toner image is formed on the surface of the electrophotographic photosensitive member 2001.

After that, the toner image which has been formed on the surface of the electrophotographic photosensitive member 2001 is transferred onto a transfer material 2006 by a transfer device 2005. Subsequently, the transfer material 2006 is separated from the surface of the electrophotographic photosensitive member 2001, and then the toner image which has been transferred onto the transfer material 2006 is fixed on the transfer material 2006 by a fixing device (not shown).

On the other hand, a toner which has remained on the surface of the electrophotographic photosensitive member 2001 without having been transferred onto the transfer material 2006 is removed by a cleaning blade 2008 in a cleaning device 2007.

Subsequently, a pre-exposing device (not shown) irradiates the surface of the electrophotographic photosensitive member 2001 with pre-exposure light 2009, and the surface of the electrophotographic photosensitive member 2001 is electrostatically discharged.

Images are continuously formed (image output) by the repetition of the above series of processes.

In recent years, an opportunity of outputting an image such as a photograph and a picture by using the electrophotographic apparatus has increased, and as a result, a requirement for an electrophotographic image to have a higher image quality has increased. The unevenness of image density (nonuniformity of image density) in particular can be easily discriminated by human eyes, and accordingly a requirement for the reduction of the unevenness of the image density has particularly increased.

One factor which causes the unevenness of the image density includes the unevenness (nonuniformity) of photosensitive-member characteristics such as charging characteristics and sensitivity characteristics of the electrophotographic photosensitive member. The unevenness of the photosensitive-member characteristics originates in the unevenness (nonuniformity) of film quality and film thickness of the film which constitutes the electrophotographic photosensitive member, in many cases.

In recent years, along with the improvement of a method for manufacturing an electrophotographic photosensitive member, the unevenness of the film quality and the film thickness of the film which constitutes the electrophotographic photosensitive member has been progressively reduced, and as a result, the unevenness of the image density has also been progressively reduced.

In addition, Japanese Patent Application Laid-Open No. H07-209930 discloses a technology of arranging a plurality of heating units in the inside of an electrophotographic photosensitive member, controlling temperatures of each of the heating units, and thereby suppressing the unevenness of the image density.

In recent years, it is required for the electrophotographic apparatus not only to form an image of high quality but also to save power from the viewpoint of environmental consideration, and an electrophotographic apparatus having no heater for an electrophotographic photosensitive member is desired.

However, there is the case in which the electrophotographic apparatus having no unit for controlling the surface temperature of the electrophotographic photosensitive member, such as the heater for the electrophotographic photosensitive member, cannot sufficiently control the unevenness of the image density, and under present circumstances, the electrophotographic apparatus still has room to be improved.

SUMMARY OF THE INVENTION

An object of the present invention is to provide an electrophotographic apparatus which suppresses the unevenness of the image density, even though the electrophotographic apparatus has no unit for controlling the surface temperature of an electrophotographic photosensitive member, such as a heater for the electrophotographic photosensitive member.

The present inventors have made an investigation for the actualization of suppressing the unevenness of the image density in the electrophotographic apparatus having no heater for the electrophotographic photosensitive member, and as a result, have found that it is one of the factors causing the unevenness of the image density that the unevenness of the surface temperature occurs on the electrophotographic photosensitive member when the image is formed (image output).

The present invention provides an electrophotographic apparatus that includes: a cylindrical electrophotographic photosensitive member having a photoconductive layer formed from amorphous silicon thereon; a charging device which electrostatically charges a surface of the electrophotographic photosensitive member; and an image exposure device which irradiates the surface of the electrophotographic photosensitive member with an image exposure beam and forms an electrostatic latent image on the surface of the electrophotographic photosensitive member; and has no unit for controlling a surface temperature of the electrophotographic photosensitive member, wherein the electrophotographic photosensitive member has such a temperature dependence of photosensitive-member characteristics that the photosensitive-member characteristics vary depending on the surface temperature, and the electrophotographic photosensitive member is arranged in the electrophotographic apparatus so that when the electrophotographic photosensitive member is equally divided into two regions in a cylindrical shaft direction, absolute values of the temperature dependence of the photosensitive-member characteristics in the two regions are not the same, and when a region out of the two regions which has a smaller absolute value of the temperature dependence of the photosensitive-member characteristics is defined as a first region, and a region which has a larger absolute value of the temperature dependence of the photosensitive-member characteristics is defined as a second region, the change of the surface temperature of the first region becomes larger than the change of the surface temperature of the second region when an image is formed by the electrophotographic apparatus.

The present invention can provide an electrophotographic apparatus which suppresses the unevenness of the image density, even though the electrophotographic apparatus has no unit for controlling the surface temperature of an electrophotographic photosensitive member, such as a heater for the electrophotographic photosensitive member.

Further features of the present invention will become apparent from the following description of Examples with reference to the attached drawings.

DESCRIPTION OF THE EMBODIMENTS

Figure 1:
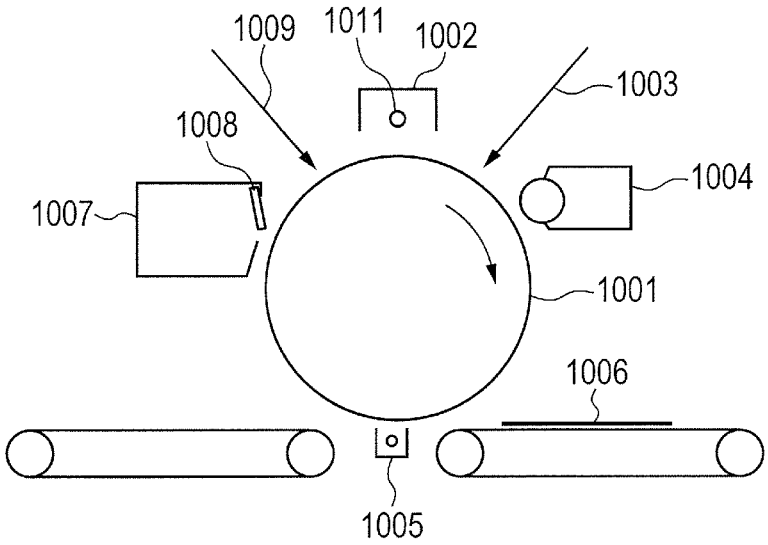
FIG. 1 is a view illustrating an example of an electrophotographic apparatus having no heater for an electrophotographic photosensitive member.
Figure 2:
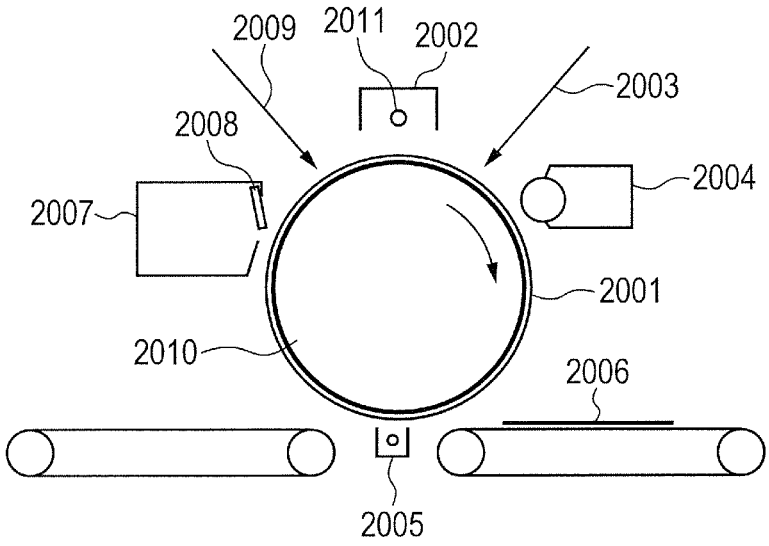
FIG. 2 (PRIOR ART)
FIG. 2 is a view illustrating an example of a conventional electrophotographic apparatus having a heater for an electrophotographic photosensitive member.

Preferred embodiments of the present invention will now be described in detail in accordance with the accompanying drawings.

The electrophotographic apparatus of the present invention is an electrophotographic apparatus having no unit (for instance, heater for electrophotographic photosensitive member or the like) for controlling the surface temperature of the electrophotographic photosensitive member, as described above. An electrophotographic photosensitive member which is used for the electrophotographic apparatus of the present invention (hereinafter also referred to as "electrophotographic photosensitive member according to the present invention") has such a temperature dependence of photosensitive-member characteristics that the photosensitive-member characteristics vary depending on the surface temperature. In addition, in the electrophotographic photosensitive member according to the present invention, when the electrophotographic photosensitive member is equally divided into two regions in a cylindrical shaft direction (rotary shaft direction), the absolute values of the temperature dependence of the photosensitive-member characteristics in those two regions are not the same. In other words, the temperature dependence of the electrophotographic photosensitive member according to the present invention has unevenness (unevenness of temperature dependence) existing in the cylindrical shaft direction of the electrophotographic photosensitive member.

In the electrophotographic apparatus of the present invention, the electrophotographic photosensitive member is arranged in the electrophotographic apparatus so that when a region out of the above described two regions which has a smaller absolute value of the temperature dependence of the photosensitive-member characteristics is defined as a first region, and a region which has a larger absolute value of the temperature dependence of the photosensitive-member characteristics is defined as a second region, the change of the surface temperature of the first region becomes larger than the change of the surface temperature of the second region when an image is formed (image output) in the electrophotographic apparatus.

The present inventors consider the reason why the above described structure can suppress the unevenness of the image density, in the following way.

One factor which causes the unevenness of the image density includes the unevenness of the surface potential of the electrophotographic photosensitive member occurring when the image is formed (image output).

When the image is formed (image output), the unevenness of the surface temperature easily occurs on the electrophotographic photosensitive member, due to an influence of the nonuniformity of air flow in the electrophotographic apparatus. In the electrophotographic photosensitive member, even if a charging condition and an image exposure condition of the electrophotographic photosensitive member has been made to be constant (uniform), photosensitive-member characteristics such as charging characteristics and sensitivity characteristics of the electrophotographic photosensitive member become nonuniform due to the unevenness of the temperature of the surface (unevenness of surface temperature) of the electrophotographic photosensitive member, and as a result, the unevenness (unevenness of surface potential) easily appears in the potential on the surface of the electrophotographic photosensitive member.

A conventional electrophotographic apparatus having a unit for controlling the surface temperature of the electrophotographic photosensitive member, such as the heater for the electrophotographic photosensitive member, has suppressed the unevenness of the surface potential of the electrophotographic photosensitive member by controlling the distribution of the surface temperature of the electrophotographic photosensitive member so as to approach a uniform distribution.

However, when the electrophotographic apparatus has no unit for controlling the surface temperature of the electrophotographic photosensitive member, such as the heater for the electrophotographic photosensitive member, from the viewpoint of environmental consideration, the electrophotographic apparatus cannot sufficiently suppress the unevenness of the surface potential, compared to the electrophotographic apparatus having the unit for controlling the surface temperature of the electrophotographic photosensitive member.

One factor which causes the nonuniform air flow in the electrophotographic apparatus includes a structure (hereinafter also referred to as "airflow structure") of air supply and exhaust in the periphery of a charging device which is arranged so as to be approximately parallel to the cylindrical shaft direction of the electrophotographic photosensitive member. The airflow structure in the periphery of the charging device is generally installed for the purpose of discharging an ozone product produced in the periphery of the charging device to the outside of the electrophotographic apparatus. The airflow structure in the periphery of the charging device includes, for instance, an air supply device for supplying air from one end side of the longitudinal direction of the charging device into the charging device, and an exhaust device for discharging air in the charging device from the one end side of the longitudinal direction of the charging device.

Figure 3A:
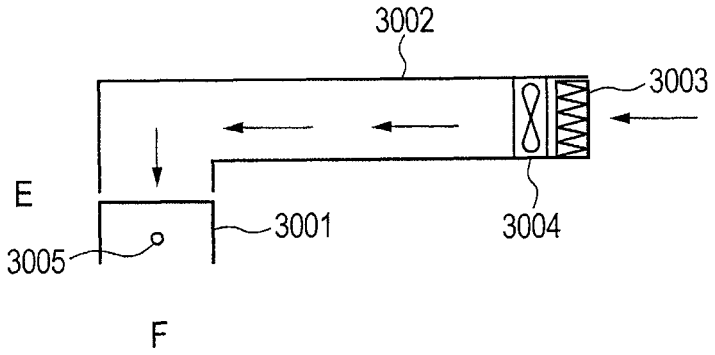
FIGS. 3A and 3B are views each illustrating an example of an airflow structure in the periphery of a charging device.
Figure 3B:
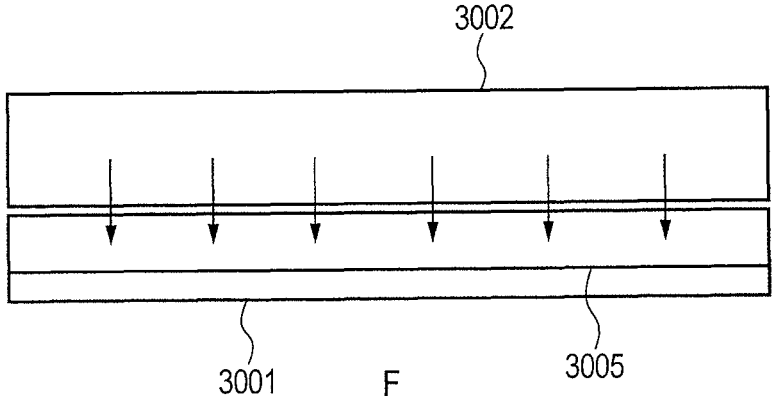
Figure 4A:
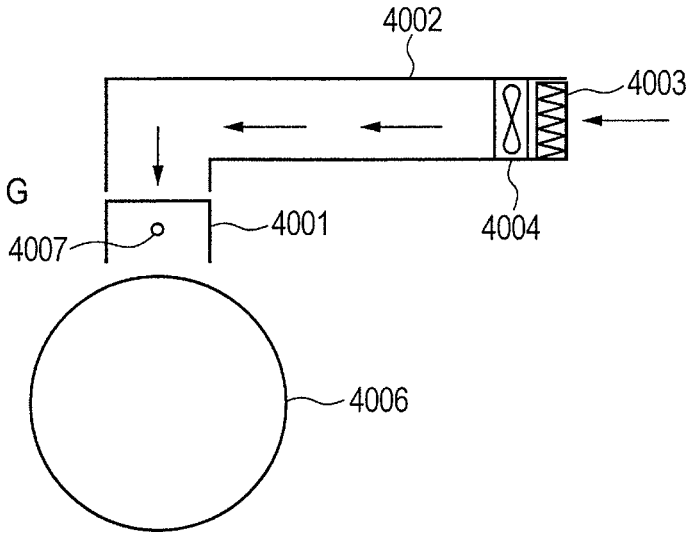
FIGS. 4A and 4B are views each illustrating an example of the airflow structure in the periphery of the charging device.
Figure 4B:
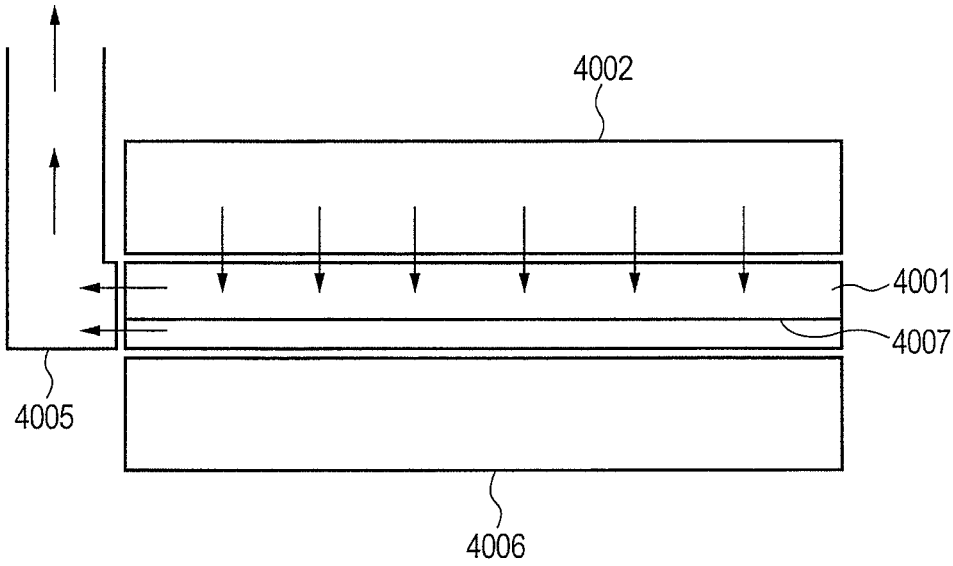

FIGS. 3A and 3B and FIGS. 4A and 4B are views each illustrating an example of an airflow structure in the periphery of the charging device. FIG. 3B is a view of the airflow structure illustrated in FIG. 3A, when viewed from the direction of E. FIG. 4B is a view of the airflow structure illustrated in FIG. 4A, when viewed from the direction of G.

In the airflow structure illustrated in FIGS. 3A and 3B, an air supply duct 3002 is provided on the upper side of a charging device 3001 having a charging wire 3005 installed therein, and air is supplied to the charging device 3001 from the outside through a dust filter 3003 and an air supply fan 3004.

Here, in order to make the air flow in the charging device 3001 approach a uniform flow, an exhaust duct (not shown) can be provided on the lower side (direction of F in FIGS. 3A and 3B) of the charging device 3001.

However, the electrophotographic photosensitive member is positioned in the direction of F of the charging device 3001, and accordingly it is difficult to provide such an exhaust duct there.

Accordingly, in an ordinary electrophotographic apparatus, the structure in general has an exhaust duct 4005 provided in one side of a charging device 4001 that has a charging wire 4007 installed therein as is illustrated in FIGS. 4A and 4B, from the viewpoint of the easiness of maintenance and the like. For this reason, the air flows become nonuniform in the exhaust duct 4005 side and the opposite side to the exhaust duct 4005 side. The air flow in the exhaust duct 4005 side becomes faster than that in the opposite side. As a result, in the electrophotographic apparatus having no unit for controlling the surface temperature of the electrophotographic photosensitive member, the surface temperature of an electrophotographic photosensitive member 4006 in the exhaust duct 4005 side becomes lower than that in the opposite side, and the unevenness of the surface temperature occurs in the electrophotographic photosensitive member 4006.

In the airflow structure illustrated in FIGS. 4A and 4B as well, an air supply duct 4002 is provided on the upper side of the charging device 4001 having the charging wire 4007 installed therein, and air is supplied to the charging device 4001 from the outside through a duct filter 4003 and an air supply fan 4004, in a similar way to the airflow structure illustrated in FIGS. 3A and 3B.

For information, the airflow structure illustrated in FIG. 4A is a structure of causing an air flow in the charging device 4001 with the air supply fan 4004, but can also be a structure of causing the air flow in the opposite direction of the direction of the air flow in the airflow structure illustrated in FIG. 4B, by using an exhaust fan instead of the air supply fan. In the case as well, the unevenness of the surface temperature occurs on the electrophotographic photosensitive member, in a similar way to the above described description.

In contrast to this, in the electrophotographic apparatus of the present invention, the electrophotographic photosensitive member is arranged in the electrophotographic apparatus so that the change of the surface temperature of a region (first region) out of the two regions formed by equally dividing the electrophotographic photosensitive member into the two regions in a cylindrical shaft direction which has a smaller absolute value of the temperature dependence of the photosensitive-member characteristics becomes larger than the change of the surface temperature of a region (second region) which has a larger absolute value of the temperature dependence of the photosensitive-member characteristics.

By such an arrangement of the electrophotographic photosensitive member in the electrophotographic apparatus, the electrophotographic apparatus can suppress the unevenness of the surface temperature of the electrophotographic photosensitive member when forming an image (image output), compared to the case in which the electrophotographic photosensitive member is arranged in the electrophotographic apparatus so that the change of the surface temperature of the second region becomes larger than the change of the surface temperature of the first region, and as a result, can suppress the unevenness of the surface potential of the electrophotographic photosensitive member.

As a result, the electrophotographic apparatus can suppress the unevenness of the image density, which originates in the unevenness of the surface potential of the electrophotographic photosensitive member, when the image is formed (image output).

For information, in the present invention, the photosensitive-member characteristics of the electrophotographic photosensitive member are characteristics of the electrophotographic photosensitive member, which are dependent on the surface temperature of the electrophotographic photosensitive member, mean characteristics of the electrophotographic photosensitive member, which affect the surface potential of the electrophotographic photosensitive member, and include, for instance, charging characteristics and sensitivity characteristics.

In addition, in the present invention, a temperature dependence of the photosensitive-member characteristics is a parameter expressed by a change rate [V/° C.] of a surface potential, which is determined when the surface temperature of the electrophotographic photosensitive member is changed after a charging condition, an image exposure condition and the like have been adjusted, and the surface potential of the electrophotographic photosensitive member has been set at a predetermined value.

If at least one of the photosensitive-member characteristics of the electrophotographic photosensitive member satisfies conditions of the present invention, the electrophotographic apparatus is included in the scope of the present invention, but at least one of the charging characteristics and the sensitivity characteristics out of the photosensitive-member characteristics can satisfy the conditions of the present invention. When the electrophotographic apparatus is an electrophotographic apparatus of a BAE system (Background Area Exposure that is an electrophotographic system of developing a portion which has not been irradiated with an image exposure beam on the surface of the electrophotographic photosensitive member, with a toner) in particular, the charging characteristics of the electrophotographic photosensitive member can further satisfy the conditions of the present invention. On the other hand, when the electrophotographic apparatus is an electrophotographic apparatus of an IAE system (Image Area Exposure that is an electrophotographic system of developing a portion which has been irradiated with an image exposure beam on the surface of the electrophotographic photosensitive member, with a toner), the sensitivity characteristics of the electrophotographic photosensitive member can further satisfy the conditions of the present invention.

In addition, an example of the airflow structure of the charging device has been quoted as one of causes of the unevenness of the surface temperature of the electrophotographic photosensitive member, but because the structure of the electrophotographic apparatus is generally not uniform for the surface of the electrophotographic photosensitive member from the viewpoint of the easiness of maintenance and the like, the cause of the unevenness of the surface temperature of the electrophotographic photosensitive member is not limited to the airflow structure. Even though the cause of the unevenness of the surface temperature of the electrophotographic photosensitive member is any cause, the effect of the present invention can be obtained.

In addition, in the present invention, the unevenness of the surface temperature of the electrophotographic photosensitive member and the unevenness of the temperature dependence of the photosensitive-member characteristics mean the unevenness in a cylindrical shaft direction of the electrophotographic photosensitive member.

FIG. 1 is a view illustrating an example of an electrophotographic apparatus having no heater for an electrophotographic photosensitive member.

An electrophotographic image is formed by the electrophotographic apparatus illustrated in FIG. 1 in the following way.

In FIG. 1, the surface of an electrophotographic photosensitive member 1001 which is rotationally driven toward the direction of the arrow is electrostatically charged by a charging device 1002. The charging potential of the surface of the electrophotographic photosensitive member 1001 is adjusted by an electric current value which is passed to a charging wire 1011 in the charging device 1002. Subsequently, the surface of the electrophotographic photosensitive member 1001 is irradiated with an image exposure beam 1003 emitted from an image exposure device (not shown), and an electrostatic latent image is formed on the surface thereof. Then, the electrostatic latent image which has been formed on the surface of the electrophotographic photosensitive member 1001 is developed by a toner which is supplied from a developing device 1004, and a toner image is formed on the surface of the electrophotographic photosensitive member 1001.

After that, the toner image which has been formed on the surface of the electrophotographic photosensitive member 1001 is transferred onto a transfer material 1006 by a transfer device 1005. Subsequently, the transfer material 1006 is separated from the surface of the electrophotographic photosensitive member 1001, and then the toner image which has been transferred onto the transfer material 1006 is fixed on the transfer material 1006 by a fixing device (not shown).

On the other hand, a toner which has remained on the surface of the electrophotographic photosensitive member 1001 without having been transferred onto the transfer material 1006 is removed by a cleaning blade 1008 in a cleaning device 1007.

Subsequently, a pre-exposing device (not shown) irradiates the surface of the electrophotographic photosensitive member 1001 with pre-exposure light 1009, and the surface of the electrophotographic photosensitive member 1001 is electrostatically discharged.

Images are continuously formed (image output) by the repetition of the above series of the processes.

Figure 5:
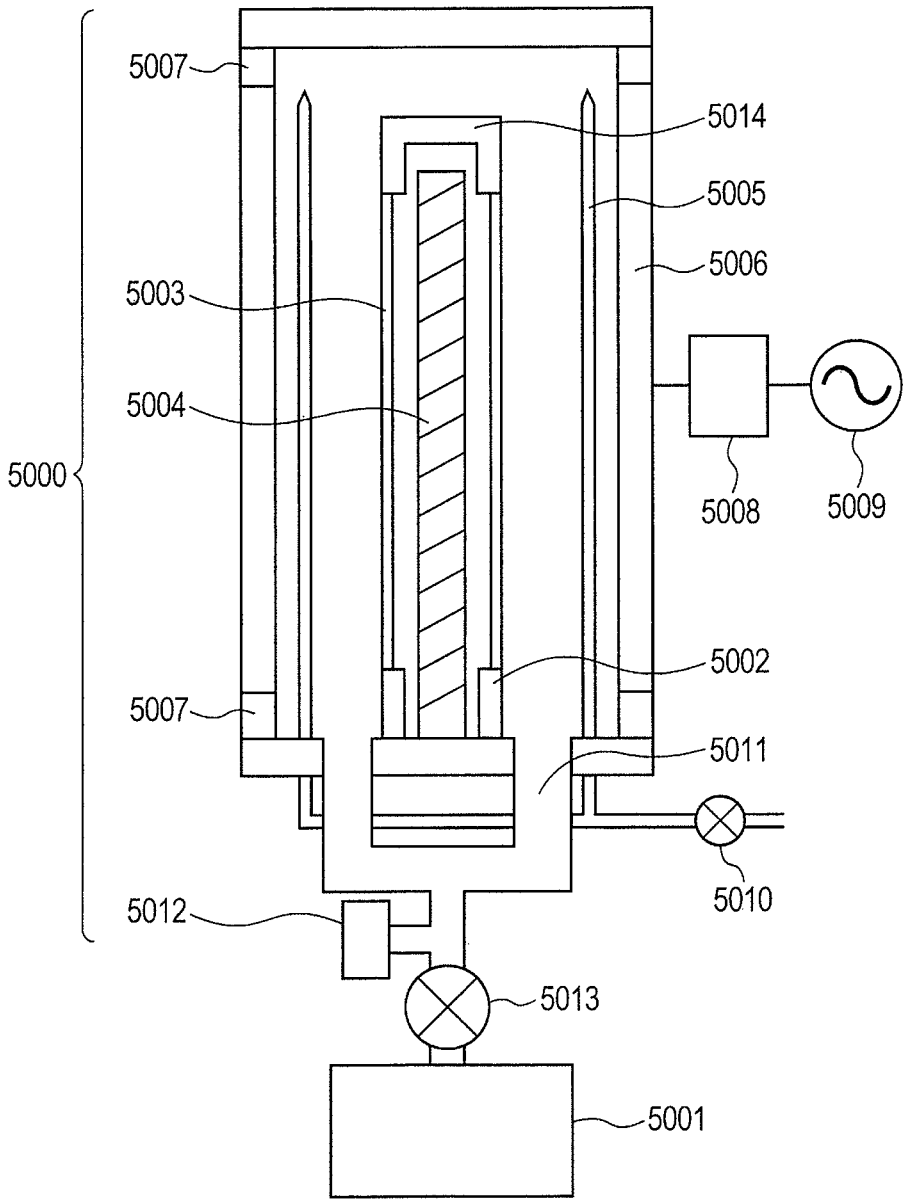
FIG. 5 is a view illustrating an example of an apparatus for forming a deposition film.

FIG. 5 is a view illustrating an example of an apparatus for forming a deposition film, which is used for manufacturing a cylindrical electrophotographic photosensitive member formed from amorphous silicon, with an RF plasma CVD method that uses a power source of a high frequency in an RF range (13.56 MHz).

The apparatus for forming the deposition film illustrated in FIG. 5 includes mainly a reaction vessel 5000, and an exhaust device 5001 for decompressing the inner part of the reaction vessel 5000. The reaction vessel 5000 has a cylindrical auxiliary substrate 5002 connected to the ground, a heater 5004 for a cylindrical substrate for heating the cylindrical substrate 5003 and a gas introduction pipe 5005 installed in its inside, respectively. The side wall portion of the reaction vessel 5000 is mainly formed of a discharge electrode 5006 made from an electroconductive material, and the discharge electrode 5006 is insulated from other portions of the reaction vessel 5000 by an insulating insulator 5007. The power source 5009 of a high frequency of 13.56 MHz is connected to the discharge electrode 5006 through a matching box 5008.

Each cylinder which constitutes a source gas supply unit (not shown) is connected to the gas introduction pipe 5005 in the inner part of the reaction vessel 5000, through a source-gas introduction valve 5010.

The reaction vessel 5000 has an exhaust pipe 5011, and can be evacuated through a main valve 5013 by an exhaust device 5001.

An example of a method for manufacturing an electrophotographic photosensitive member by using the apparatus for forming the deposition film illustrated in FIG. 5 will be described below.

The cylindrical substrate 5003 having a surface which has been subjected to a mirror finishing process with the use of a lathe or the like is installed on the cylindrical auxiliary substrate 5002, so as to surround the heater 5004 for the cylindrical substrate in the inner part of the reaction vessel 5000, and a cap 5014 is set thereon.

Next, the main valve 5013 is opened, and the inside of the reaction vessel 5000 and the gas introduction pipe 5005 is exhausted. When the reading of a vacuum gauge 5012 has reached a predetermined pressure or less (for instance, 1 Pa), the source-gas introduction valve 5010 is opened, and an inert gas (for instance, argon gas) for heating is introduced into the inner part of the reaction vessel 5000 through the gas introduction pipe 5005. Then, the flow rate of the inert gas for heating, the opening quantity of the main valve 5013, the exhaust speed of the exhaust device 5001 and the like are adjusted so that the inner part of the reaction vessel 5000 reaches a predetermined pressure.

After that, a temperature controller (not shown) is operated to make the heater 5004 for the cylindrical substrate heat the cylindrical substrate 5003, and controls the temperature of the cylindrical substrate 5003 to a predetermined temperature (for instance, 50 to 500° C.) When the temperature of the cylindrical substrate 5003 has reached the predetermined temperature, the source gas for forming the deposition film is gradually introduced into the inner part of the reaction vessel 5000 while the introduction of the inert gas is gradually stopped. The source gas includes, for instance: a material gas including a silicon hydride gas such as $SiH_4$ and $Si_2H_6$, and a hydrocarbon gas such as $CH_4$ and $C_2H_6$; and a doping gas such as $B_2H_6$ and $PH_3$. When the source gas is introduced, the flow rate of the source gas is adjusted so as to become a predetermined flow rate, by a massflow controller (not shown). At this time, the operator adjusts the opening quantity of the main valve 5013, the exhaust speed of the exhaust device 5001 and the like so that the pressure in the inner part of the reaction vessel 5000 is kept at a predetermined value, while watching a vacuum gauge 5012.

After the preparation for forming the deposition film has been completed by the above described procedures, the deposition film is formed on the cylindrical substrate 5003. After it has been confirmed that the pressure in the inner part of the reaction vessel 5000 is stable, the high-frequency power source 5009 is set at a predetermined electric power, the high-frequency electric power is supplied to the discharge electrode 5006, and a high-frequency glow discharge is generated in the inner part of the reaction vessel 5000. At this time, the operator adjusts the matching box 5008 so that the reflected electric power becomes minimal, and sets an effective value obtained by deducting the reflected electric power from the incident electric power of the high-frequency electric power, at a predetermined value. This discharge energy decomposes the source gas which has been introduced into the inner part of the reaction vessel 5000, and a deposition film is formed on the cylindrical substrate 5003. For information, while the deposition film is formed, the cylindrical substrate 5003 may be rotated around its center axis line at a predetermined speed by a driving device (not shown). After the deposition film with a predetermined thickness has been formed, the supply of the high-frequency electric power is stopped, and the inflow of the source gas into the inner part of the reaction vessel 5000 is stopped. A plurality of deposition films are sequentially formed by changing the type of the source gas and the conditions of the high-frequency electric power and the like, as needed. After that, the inner part of the reaction vessel 5000 is once made to be a high vacuum, and then the formation of the deposition film is finished.

By the above described operation, the electrophotographic photosensitive member can be manufactured.

Figure 6A:
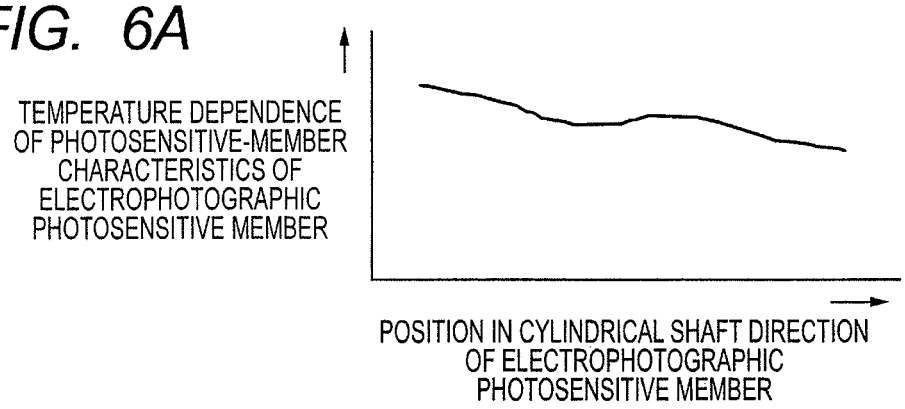
FIG. 6A is a view illustrating an example of the unevenness of temperature dependence of the photosensitive-member characteristics of the electrophotographic photosensitive member.

FIG. 6A is a view illustrating an example of unevenness (unevenness of temperature dependence) of temperature dependence of the photosensitive-member characteristics (charging characteristics, sensitivity characteristics and the like) in a cylindrical shaft direction, in the electrophotographic photosensitive member formed from amorphous silicon, which has been manufactured by the above described manufacturing method. The shape of the unevenness of the temperature dependence has some inflection points in the cylindrical shaft direction of the electrophotographic photosensitive member, but becomes an almost gently changing shape over the whole in the cylindrical shaft direction. In the electrophotographic photosensitive member formed from amorphous silicon, which has been manufactured by the ordinary manufacturing method as described above, the unevenness of the temperature dependence shows generally a gentle shape as is illustrated in FIG. 6A because of properties of the manufacturing method, and such an unevenness as to locally largely change does not occur.

Figure 7:
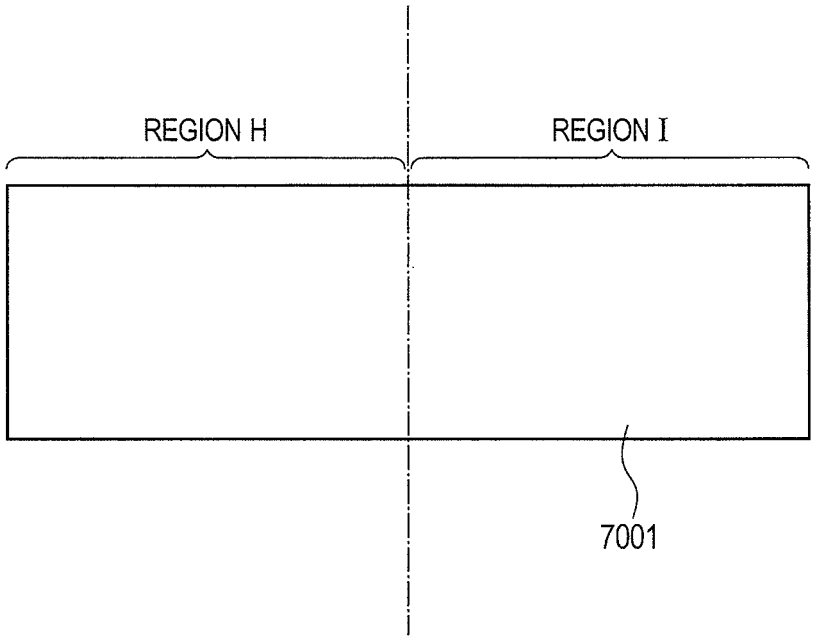
FIG. 7 is a view illustrating an example of an electrophotographic photosensitive member.

Accordingly, as is illustrated in FIG. 7, when the electrophotographic photosensitive member 7001 is equally divided into two regions (region H and region I) in a cylindrical shaft direction, and the temperature dependence of the electrophotographic photosensitive member is averaged in each range of the region H and the region I, a relationship of a magnitude of an absolute value of the temperature dependence of the electrophotographic photosensitive member can be determined by the absolute value of the average value of the temperature dependence. In the present invention, the relationship of the magnitude of the absolute value of the temperature dependence was determined in this way.

Figure 6B:
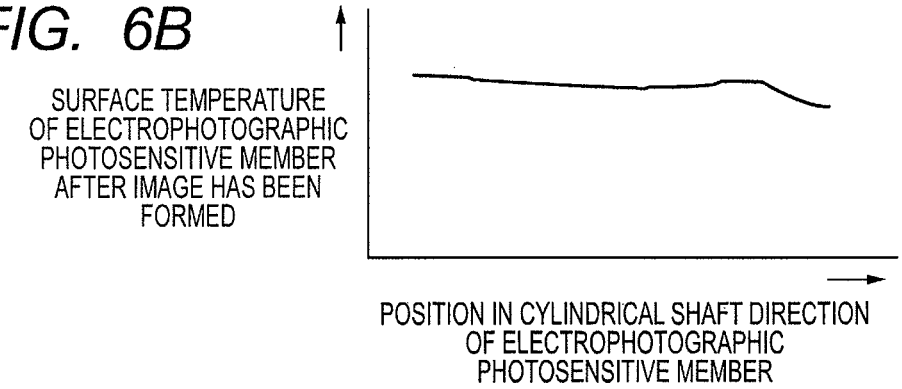
FIG. 6B is a view illustrating an example of the unevenness of the surface temperature of the electrophotographic photosensitive member, which occurs when image formation (image output) is repeated.

In addition, FIG. 6B is a view illustrating an example of unevenness (unevenness of surface temperature) of the surface temperature in a cylindrical shaft direction of the electrophotographic photosensitive member, which occurs when images are (continuously) formed (image output) by the electrophotographic apparatus. The shape of the unevenness of the surface temperature has some inflection points in the cylindrical shaft direction of the electrophotographic photosensitive member, but becomes the almost gently changing shape over the whole in the cylindrical shaft direction. When images are (continuously) formed (image output) by the electrophotographic apparatus having an ordinary structure, the unevenness of the surface temperature of the electrophotographic photosensitive member, which occurs in the electrophotographic apparatus, generally becomes a gentle shape as is illustrated in FIG. 6B, and such an unevenness as to locally largely change does not occur.

Accordingly, as is illustrated in FIG. 7, by equally dividing the electrophotographic photosensitive member 7001 into two regions (region H and region I) in a cylindrical shaft direction, and averaging the surface temperature of the electrophotographic photosensitive member in each range of the region H and the region I, the relationship of the magnitude of the change of the surface temperature of the electrophotographic photosensitive member can be determined. In the present invention, the relationship of the magnitude of the change of the surface temperature was determined in this way.

In addition, in the present invention, when the temperature dependence of the photosensitive-member characteristics in a certain portion of the electrophotographic photosensitive member is expressed by $\alpha$ [V/° C.] and the change of the surface temperature there is expressed by $\Delta T$ [° C.], a difference $\Delta(\alpha \cdot \Delta T)$ between the value of $\alpha \cdot \Delta T$ in a portion at which a value of $\alpha \cdot \Delta T$ that is a product of $\alpha$ and $\Delta T$ becomes maximal and the value of $\alpha \cdot \Delta T$ in a portion at which the value of $\alpha \Delta T$ becomes minimal can satisfy a relationship between the $\Delta(\alpha \cdot \Delta T)$ and a latent image contrast potential Vc [V] that is defined by a difference between a potential in a portion that has been irradiated with an image exposure beam on the surface of the electrophotographic photosensitive member when an image is formed (image output) and a potential in a portion that has not been irradiated with the image exposure beam on the surface of the electrophotographic photosensitive member at the time, which is expressed by the following expression:

$$\Delta(\alpha \cdot \Delta T) \leq 0.07 \cdot Vc.$$

If $\Delta(\alpha \cdot \Delta T)$ is $0.07 \cdot Vc$ or less, the variation of the unevenness of the image density before and after the images are continuously formed (image output) is controlled to be small. Accordingly, if $\Delta(\alpha \cdot \Delta T)$ is $0.07 \cdot Vc$ or less, a level of the suppressed unevenness of the image density in an initial state (before the images are continuously formed (image output)) is easily kept even after the images have been continuously formed (image output).

Figure 6C:
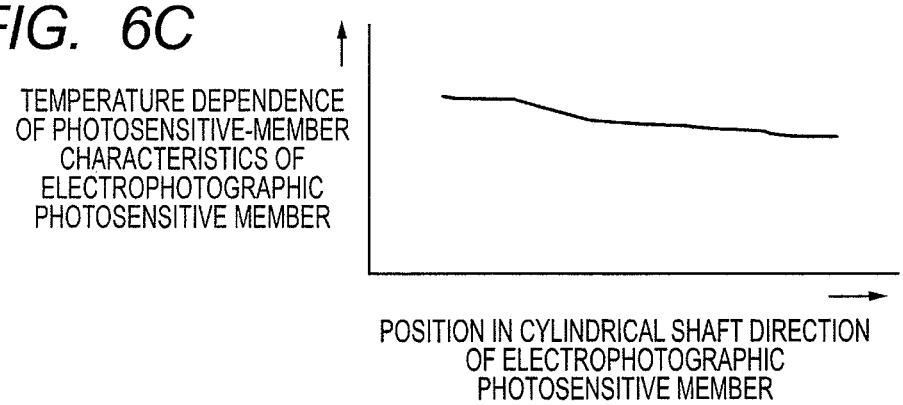
FIG. 6C is a view illustrating an example of the unevenness of the temperature dependence of the photosensitive-member characteristics of the electrophotographic photosensitive member.
Figure 6D:
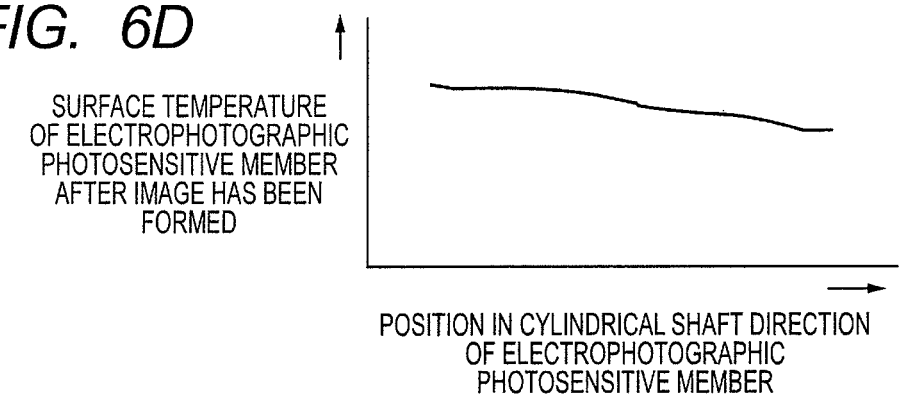
FIG. 6D is a view illustrating an example of the unevenness of the surface temperature of the electrophotographic photosensitive member, which occurs when image formation (image output) is repeated.

In addition, in the present invention, when the degree of the temperature dependence of the photosensitive-member characteristics of the electrophotographic photosensitive member monotonously increases from one end side toward the other end side in the cylindrical shaft direction of the electrophotographic photosensitive member, the degree of the change of the surface temperature of the electrophotographic photosensitive member when the image is formed (image output) by the electrophotographic apparatus can monotonously decrease from one end side toward the other end side in the cylindrical shaft direction of the electrophotographic photosensitive member. The monotonous increase or decrease described here means that the value increases or decreases without having an inflection point over the whole in the cylindrical shaft direction, for instance, as is illustrated in FIG. 6C or FIG. 6D. The increase or decrease in such a shape as to have the inflection point as is illustrated in FIG. 6A or FIG. 6B does not correspond to the monotonous increase or decrease defined here.

For information, the shape of the unevenness of the temperature dependence of the photosensitive-member characteristics of the electrophotographic photosensitive member can be changed by adjusting, for instance, the gas introduction pipe of the apparatus illustrated in FIG. 5 for forming the deposition film.

In addition, the unevenness of the surface temperature of the electrophotographic photosensitive member can be made so as to have a shape which monotonously changes as is illustrated in FIG. 6D, for instance, by enhancing air supply and exhaust and thereby reducing other factors of the temperature change, in the airflow structure illustrated in FIGS. 4A and 4B.

The present invention will be described further in detail below with reference to Examples and comparative examples, but shall not be limited by those.

Examples 1-1 to 1-5

The surfaces (peripheral surface) of cylindrical bodies made from aluminum with a length of 358 mm were subjected to a mirror finishing process with the use of a lathe, and a total of five cylindrical substrates with the length of 358 mm and an outer diameter of 80 mm were produced.

Subsequently, deposition films of a charge injection blocking layer, a first photoconductive layer, a second photoconductive layer, an intermediate layer and a surface layer were formed in this order on the cylindrical substrates, respectively, with the use of the apparatus for forming the deposition film as illustrated in FIG. 5, on conditions illustrated in Table 1, and thereby a total of five electrophotographic photosensitive members were manufactured. These electrophotographic photosensitive members shall be named as electrophotographic photosensitive members of Examples 1-1 to 1-5.

TABLE 1

| | Charge injection blocking layer | First photo-conductive layer | Second photo-conductive layer | Inter-mediate layer | Surface layer |
|---|---|---|---|---|---|
| Type of gas and flow rate [mL/min (normal)] | | | | | |
| $SiH_4$ | 350 | 550 | 550 | 550⇒26 | 26 |
| $H_2$ | 750 | 2200 | 2200 | | |
| $B_2H_6$ [ppm] (vs. $SiH_4$) | 1500 | 0.5 | | | |
| NO | 10 | | | | |
| $CH_4$ | | | | 0⇒400 | 400 |
| Temperature of cylindrical substrate [° C.] | 260 | 260 | 260 | 290 | 290 |
| Pressure in inner part of reaction vessel [Pa] | 40 | 80 | 80 | 80 | 80 |
| High-frequency electric power [W] | 400 | 1000 | 1000 | 800 | 800 |
| Layer thickness [μm] | 3 | 25 | 5 | 0.3 | 0.5 |

The arrow "⇒" in Table 1 means that the flow rate of the gas is controlled to increase or decrease from a left value to a right value.

Figure 8A:
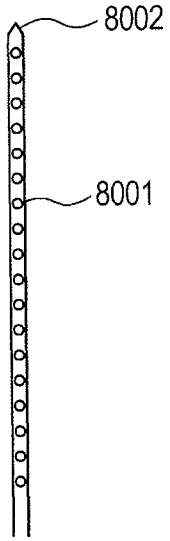
FIGS. 8A, 8B, 8C and 8D are views each illustrating an example of a gas pipe in an apparatus for manufacturing the electrophotographic photosensitive member.
Figure 8B:
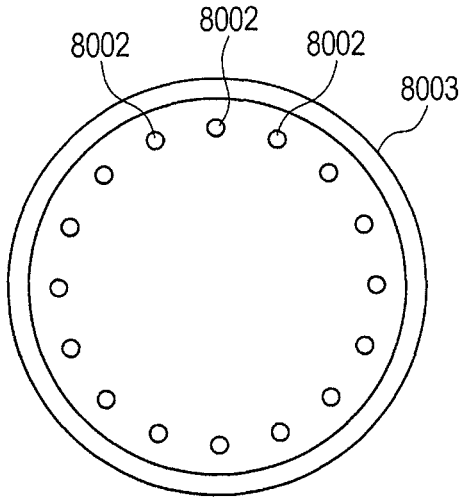

Incidentally, in the present Example, a gas pipe 8002 having gas blowing holes 8001 distributed therein as illustrated in FIG. 8A was used as a gas pipe 5005 illustrated in FIG. 5, and sixteen gas pipes 8002 were arranged in the inner part of the reaction vessel 8003 as illustrated in FIG. 8B.

In addition, as is illustrated in FIG. 8A, the distribution of the gas blowing hole 8001 in the gas pipe 8002 is almost uniform.

Subsequently, the temperature dependence ($\alpha a$) of charging characteristics (photosensitive-member characteristics) of each of the manufactured electrophotographic photosensitive members was measured with the method which would be described below by using an apparatus for measuring the photosensitive-member characteristics of the electrophotographic photosensitive member illustrated in FIG. 9, and the unevenness of the temperature dependence of the charging characteristics of the electrophotographic photosensitive member was determined. The result is shown in Table 2 with the result of after-mentioned comparative examples 1-1 to 1-5. The values of the unevenness of the temperature dependence of the charging characteristics of the electrophotographic photosensitive members were different among each of the electrophotographic photosensitive members due to the variation in manufacture.

TABLE 2

| Absolute value of temperature dependence of charging characteristics of electrophotographic photosensitive member (V/° C.) | Region H | Region I |
|---|---|---|
| Example 1-1 | 2.4 | 1.6 |
| Example 1-2 | 2.0 | 1.2 |

TABLE 2-continued

| Absolute value of temperature dependence of charging characteristics of electrophotographic photosensitive member (V/° C.) | Region H | Region I |
|---|---|---|
| Example 1-3 | 1.9 | 1.0 |
| Example 1-4 | 1.6 | 1.0 |
| Example 1-5 | 1.7 | 0.9 |
| Comparative Examples 1-1 | 2.3 | 1.5 |
| Comparative Examples 1-2 | 1.9 | 1.1 |
| Comparative Examples 1-3 | 2.0 | 1.1 |
| Comparative Examples 1-4 | 1.7 | 1.0 |
| Comparative Examples 1-5 | 1.8 | 1.0 |

Incidentally, the shape of the unevenness of the temperature dependence of the charging characteristics of each of the electrophotographic photosensitive members was a shape partially having inflection points as illustrated in FIG. 6A.

Next, the electrophotographic photosensitive member was installed in an electrophotographic type of a copying machine (trade name: iR5075) which was made by Canon Inc. and was remodeled into a structure having no heater for an electrophotographic photosensitive member, and 5000 sheets of images were continuously output with the use of an A4 test pattern with a print rate of 1%, in a low-temperature environment at a temperature of 15° C. and with a relative humidity of 50%. The change ($\Delta T\alpha$) of the surface temperature of the electrophotographic photosensitive member before and after the continuous image output was measured with the method described below, and the unevenness of the surface temperature of the electrophotographic photosensitive member was determined. The result is shown in Table 3.

TABLE 3

| | Region J | Region K |
|---|---|---|
| Surface temperature of electrophotographic photosensitive member before 5,000 sheets of images are continuously output (° C.) | 15 | 15 |
| Surface temperature of electrophotographic photosensitive member after 5,000 sheets of images have been continuously output (° C.) | 30 | 34 |

As is understood from Table 3, the surface temperature of the electrophotographic photosensitive member varies due to a continuous output of the images, and the unevenness of the surface temperature occurs on the electrophotographic photosensitive member.

Incidentally, in the present Example, the airflow structure illustrated in FIGS. 4A and 4B was adopted.

In addition, the shape of the unevenness of the surface temperature of the electrophotographic photosensitive member before and after the images were continuously output was a shape which had no inflection point and monotonously changed, as illustrated in FIG. 6D.

Subsequently, each of the manufactured electrophotographic photosensitive members were each installed in the above described electrophotographic type of a copying machine (trade name: iR5075) made by Canon Inc. At this time, a portion which had a smaller absolute value of the temperature dependence of the charging characteristics of the electrophotographic photosensitive member was set in a side which had a larger degree of the change of the surface temperature of the electrophotographic photosensitive member before and after the images were continuously output. In addition, a portion which had a larger absolute value of the temperature dependence of the charging characteristics of the electrophotographic photosensitive member was set in a side which had a smaller degree of the change of the surface temperature of the electrophotographic photosensitive member. Incidentally, the relationships of the magnitudes of the temperature dependence of the charging characteristics of the electrophotographic photosensitive member and the change of the surface temperature thereof were determined from Table 2 and Table 3.

The maximum value and the minimum value of $\alpha a \cdot \Delta Ta$ in a state in which each of the electrophotographic photosensitive members were installed in the above described copying machine according to the above described positional relationship were calculated from a measurement result of the temperature dependence ($\alpha a$) of the charging characteristics of each of the electrophotographic photosensitive members, and a measurement result of the change ($\Delta Ta$) of the surface temperature of the electrophotographic photosensitive members before and after the images of 5000 sheets were continuously output. A difference $\Delta(\alpha a \cdot \Delta Ta)$ between the maximum value and the minimum value is shown in Table 4.

TABLE 4

| | $\Delta(\alpha a \cdot \Delta Ta)$ |
|---|---|
| Example 1-1 | 22.2 |
| Example 1-2 | 15.4 |
| Example 1-3 | 19.6 |
| Example 1-4 | 14.8 |
| Example 1-5 | 17.8 |

Next, 5,000 sheets of images were continuously output in a low-temperature environment of a temperature of 15° C. and a relative humidity of 50% with the use of an A4 test pattern with a print rate of 1%.

(Method for Measuring Unevenness of Temperature Dependence of Charging Characteristics of Electrophotographic Photosensitive Member)

Figure 9:
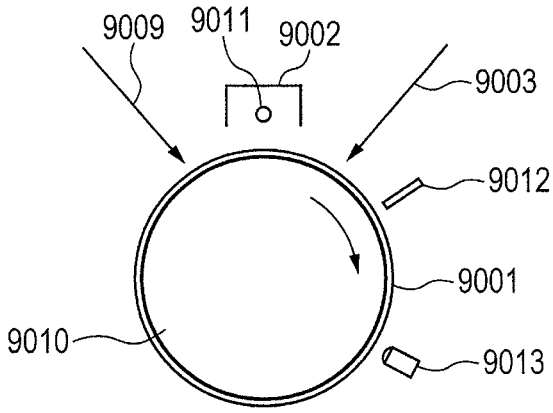
FIG. 9 is a view illustrating an example of an apparatus for measuring the photosensitive-member characteristics of the electrophotographic photosensitive member.

FIG. 9 is a view illustrating an example of an apparatus for measuring the photosensitive-member characteristics of the electrophotographic photosensitive member. A charging device 9002, an image exposure device (not shown) which irradiates the electrophotographic photosensitive member with an image exposure beam 9003, a temperature sensor (made by KEYENCE CORPORATION, trade name: IT2-01) 9013, and a pre-exposing device (not shown) which irradiates the electrophotographic photosensitive member with pre-exposure light 9009 are arranged in the periphery of the electrophotographic photosensitive member 9001. Furthermore, a potential sensor (surface potential meter) (made by TREK, INC., trade name: MODEL344) 9012 is installed at a position of a developing device 1004 in FIG. 1, instead of the developing device 1004. Furthermore, a heater 9010 for an electrophotographic photosensitive member is installed in the inside of the electrophotographic photosensitive member 9001.

The electrophotographic photosensitive member 9001 was rotated in a direction of the arrow, and a pre-exposing device (not shown) of which the condition was set at predetermined conditions irradiated the surface of the electrophotographic photosensitive member 9001 with pre-exposure light 9009. Subsequently, the surface temperature of the electrophotographic photosensitive member 9001 was monitored with a temperature sensor 9013, and the heater 9010 for the electrophotographic photosensitive member was controlled so that the surface temperature became a predetermined value (hereinafter referred to as "T1"). An electric current value which was passed to a charging wire 9011 installed in the charging device 9002 was adjusted so that the potential of a dark portion in a potential sensor in a state that the surface temperature was T1 became a predetermined potential (hereinafter referred to as "V1"). Here, the potential V1 is an average value of values in one perimeter of the electrophotographic photosensitive member.

Subsequently, the heater 9010 for the electrophotographic photosensitive member was controlled so that the surface temperature of the electrophotographic photosensitive member 9001 became a predetermined value (hereinafter referred to as "T2") without changing conditions of the pre-exposing device (not shown) and the charging device 9002. The potential of the dark portion in the potential sensor 9012 in a state that the surface temperature was T2 was measured (hereinafter referred to as "V2"). Here, the potential V2 is an average value of values in one perimeter of the electrophotographic photosensitive member.

The value calculated by the following expression was determined to be the temperature dependence of the charging characteristics of the electrophotographic photosensitive member.

Temperature dependence of charging characteristics of electrophotographic photosensitive member=(V1−V2)/(T1−T2)

Incidentally, in the present Example, T1 was set at 25° C., T2 was set at 40° C. and V1 was set at 500 V.

The center position of the electrophotographic photosensitive member in the cylindrical shaft direction was determined to be 0 mm, measurement positions of 15 points in total at spaces of 20 mm toward both end portions therefrom were determined, and the temperature dependence of the charging characteristics of the electrophotographic photosensitive member in each of the measurement positions was measured with the above described method.

The electrophotographic photosensitive member was equally divided into two regions of region H and region I in a cylindrical shaft direction, as illustrated in FIG. 7, the measurement values of the temperature dependence of the charging characteristics in each range of the region H and the region I were averaged, and the unevenness of the temperature dependence of the charging characteristics of the electrophotographic photosensitive member was determined according to the absolute value of the average value. Here, the measurement value at the position of 0 mm is included in both of the region H and the region I.

(Method for Measuring Unevenness of Surface Temperature of Electrophotographic Photosensitive Member)

The center position in the cylindrical shaft direction of the electrophotographic photosensitive member was determined to be 0 mm, measurement positions of 15 points in total at spaces of 20 mm toward both end portions were determined, the surface temperatures in four positions at spaces of 90° in the circumferential direction were measured at each of the measurement positions, and the average values were obtained. Incidentally, the surface temperature of the electrophotographic photosensitive member was measured with the use of a contact thermometer (made by Anritsu Meter Co., Ltd., trade name: HFT-51).

Figure 10:
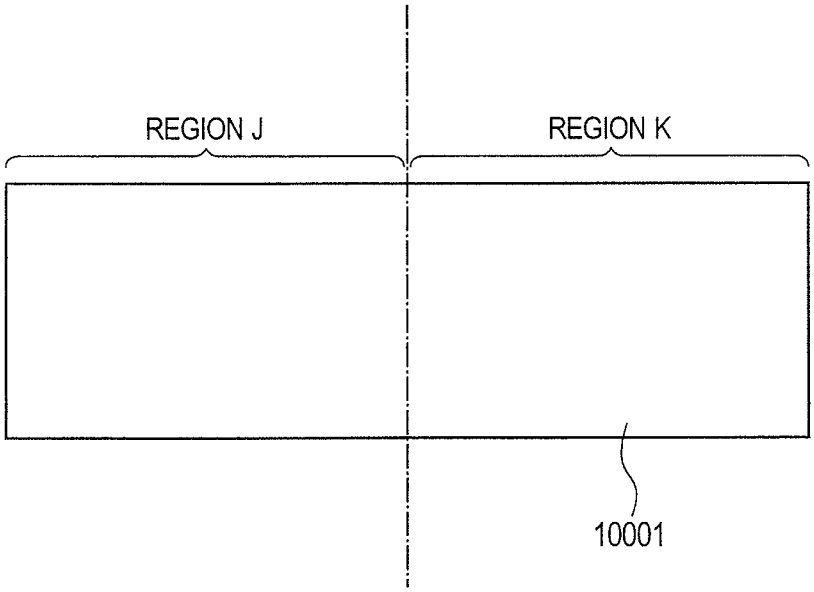
FIG. 10 is a view illustrating an example of an electrophotographic photosensitive member.

As is illustrated in FIG. 10, the electrophotographic photosensitive member 10001 was equally divided into two regions in the cylindrical shaft direction, and a region in an exhaust side of the airflow structure of the charging device was determined to be a region J, while a region in the other side was determined to be a region K. The measurement values for the surface temperature were averaged in each range of the region J and the region K, and the average surface temperature was obtained. Here, the measurement value at the position of 0 mm is included in both of the region J and the region K.

Comparative Examples 1-1 to 1-5

A total of five electrophotographic photosensitive members (electrophotographic photosensitive members of Comparative Examples 1-1 to 1-5) which were manufactured respectively in a similar way to that for Examples 1-1 to 1-5 were each installed in the above described electrophotographic type of the copying machine (trade name: iR5075) which was made by Canon Inc. and was remodeled into a structure having no heater for the electrophotographic photosensitive member. At this time, a portion which had a larger absolute value of temperature dependence of the charging characteristics of the electrophotographic photosensitive member was set in a side which had a larger degree of the change of the surface temperature of the electrophotographic photosensitive member before and after the images were continuously output. In addition, a portion which had a smaller absolute value of the temperature dependence of the charging characteristics of the electrophotographic photosensitive member was set in a side which had a smaller degree of the change of the surface temperature of the electrophotographic photosensitive member. Incidentally, the relationships of the magnitudes of the temperature dependence of the charging characteristics of the electrophotographic photosensitive member and the change of the surface temperature thereof were determined from Table 2 and Table 3, similarly to those in Examples 1-1 to 1-5.

Next, 5,000 sheets of images were continuously output in a low-temperature environment of a temperature of 15° C. and a relative humidity of 50% with the use of an A4 test pattern with a print rate of 1%.

(Evaluation of Unevenness of Image Density)

The image density was measured on images before and after 5,000 sheets of the images were continuously output in Examples 1-1 to 1-5 and Comparative Examples 1-1 to 1-5, with the method which would be described below, and the unevenness of image density was evaluated.

The result is shown in Table 5.

(Evaluation Method of Unevenness of Image Density)

The electrophotographic photosensitive member was installed in the electrophotographic type of the copying machine (trade name: iR5075) which was made by Canon Inc. and was remodeled into the structure having no heater for an electrophotographic photosensitive member, and a halftone image having a pixel density of 37.5% was output.

Incidentally, the potential of a portion which was not irradiated with an image exposure beam when the images were formed (image output) was set at 500 V, the potential of a portion which was irradiated with the image exposure beam was set at 120 V, and the latent image contrast potential Vc was set at 380 V.

In the acquired image, the region corresponding to one perimeter of the electrophotographic photosensitive member was equally divided into 180 blocks (equally divided into 15 sections in the cylindrical shaft direction and into 12 sections in the circumferential direction). The image density of each block was measured by using a reflection density meter (spectral density meter) (made by X-Rite, Incorporated, tradename: 504 Spectrodensitometer).

Next, 5,000 sheets of images were continuously output in a low-temperature environment of a temperature of 15° C. and a relative humidity of 50% with the use of an A4 test pattern with a print rate of 1%, and then a halftone image was output. The image density of each block in the acquired image was measured with the method described above.

The difference between image densities before and after 5,000 sheets of images were continuously output was determined in each block. The value Max−Min was determined from the maximum value (Max) and the minimum value (Min) of obtained difference, and used as an index of the unevenness of the image density. Therefore, the smaller the value is, the smaller the unevenness is of image density.

In each of the manufactured electrophotographic photosensitive members, the indices were classified into the following ranks with reference to Comparative Examples. The result is shown in Table 5.

A: less than 40% with respect to Comparative Example.

B: 40% or more but less than 95% with respect to Comparative Example.

C: 95% or more but less than 105%, in other words, the same level with respect to Comparative Example.

D: 105% or more with respect to Comparative Example.

Incidentally, Example 1-1 is evaluated with reference to Comparative Example 1-1, Example 1-2 is evaluated with reference to Comparative Example 1-2, Example 1-3 is evaluated with reference to Comparative Example 1-3, Example 1-4 is evaluated with reference to Comparative Example 1-4, and Example 1-5 is evaluated with reference to Comparative Example 1-5.

TABLE 5

| | Unevenness of image density |
|---|---|
| Example 1-1 | B |
| Example 1-2 | B |
| Example 1-3 | B |
| Example 1-4 | B |
| Example 1-5 | B |

As is clear from the result in Table 5, the unevenness of image density can be controlled by installing a portion which has the smaller absolute value of the temperature dependence of the charging characteristics of the electrophotographic photosensitive member in a side which has a larger degree of the change of the surface temperature of the electrophotographic photosensitive member before and after the images are continuously output, and installing the portion which has the larger absolute value of the temperature dependence of the charging characteristics of the electrophotographic photosensitive member in a side which shows a smaller degree of the change of the surface temperature thereof.

Examples 2-1 to 2-5

The surfaces (peripheral surface) of cylindrical bodies made from aluminum with a length of 358 mm were subjected to a mirror finishing process with the use of a lathe, and a total of five cylindrical substrates with the length of 358 mm and an outer diameter of 108 mm were produced.

Subsequently, deposition films of a charge injection blocking layer, a first photoconductive layer, a second photoconductive layer, an intermediate layer and a surface layer were formed in this order on the cylindrical substrates, respectively, with a method similar to that for Examples 1-1 to 1-5, and thereby a total of five electrophotographic photosensitive members were manufactured. These electrophotographic photosensitive members shall be named as the electrophotographic photosensitive members of Examples 2-1 to 2-5.

Subsequently, the temperature dependence (αb) of the sensitivity characteristics of each of the manufactured electrophotographic photosensitive members was measured with the method which would be described below, by using an apparatus for measuring the photosensitive-member characteristics of the electrophotographic photosensitive member illustrated in FIG. 9, and the unevenness of the temperature dependence of the sensitivity characteristics of the electrophotographic photosensitive member was determined. The result is shown in Table 6 with the result of after-mentioned comparative examples 2-1 to 2-5. The values of the unevenness of the temperature dependence of the sensitivity characteristics of the electrophotographic photosensitive members were different among each of the electrophotographic photosensitive members due to the variation in manufacture.

TABLE 6

| Absolute value of temperature dependence of sensitivity characteristics of electrophotographic photosensitive member (V/° C.) | Region H | Region I |
|---|---|---|
| Example 2-1 | 1.8 | 1.1 |
| Example 2-2 | 1.5 | 1.0 |
| Example 2-3 | 1.4 | 0.8 |
| Example 2-4 | 1.5 | 1.1 |
| Example 2-5 | 1.2 | 0.8 |
| Comparative Examples 2-1 | 1.7 | 1.1 |
| Comparative Examples 2-2 | 1.6 | 1.0 |
| Comparative Examples 2-3 | 1.6 | 0.9 |
| Comparative Examples 2-4 | 1.6 | 1.2 |
| Comparative Examples 2-5 | 1.5 | 1.0 |

Incidentally, the shape of the unevenness of the temperature dependence of the sensitivity characteristics of each of the electrophotographic photosensitive members was a shape partially having inflection points as illustrated in FIG. 6A.

Next, the electrophotographic photosensitive member was installed in an electrophotographic type of a copying machine (trade name: iR7105) which was made by Canon Inc. and was remodeled into a structure having no heater for an electrophotographic photosensitive member, and the change (ΔTb) of the surface temperature of the electrophotographic photosensitive member before and after 5,000 sheets of images were continuously output was measured with a method similar to that in Example 1, and the unevenness of the surface temperature of the electrophotographic photosensitive member was determined. The result is shown in Table 7.

TABLE 7

| | Region J | Region K |
|---|---|---|
| Surface temperature of electrophotographic photosensitive member before 5,000 sheets of images are continuously output (° C.) | 15 | 15 |

TABLE 7-continued

| | Region J | Region K |
|---|---|---|
| Surface temperature of electrophotographic photosensitive member after 5,000 sheets of images have been continuously output (° C.) | 28 | 31 |

As is understood from Table 7, it is understood that the surface temperature of the electrophotographic photosensitive member varies due to a continuous output of the images, and the unevenness of the surface temperature occurs on the electrophotographic photosensitive member.

Incidentally, in the present Example, the airflow structure illustrated in FIGS. 4A and 4B was adopted.

In addition, the shape of the unevenness of the surface temperature of the electrophotographic photosensitive member before and after the images were continuously output was a shape which had no inflection point and monotonously changed, as illustrated in FIG. 6D.

Subsequently, each of the manufactured electrophotographic photosensitive members were each installed in the above described electrophotographic type of the copying machine (trade name: iR7105) made by Canon Inc. At this time, a portion which had a smaller absolute value of the temperature dependence of the sensitivity characteristics of the electrophotographic photosensitive member was set in a side which had a larger degree of the change of the surface temperature of the electrophotographic photosensitive member before and after the images were continuously output. In addition, a portion which had a larger absolute value of the temperature dependence of the sensitivity characteristics of the electrophotographic photosensitive member was set in a side which had a smaller degree of the change of the surface temperature of the electrophotographic photosensitive member. Incidentally, the relationships of the magnitudes of the temperature dependence of the sensitivity characteristics of the electrophotographic photosensitive member and the change of the surface temperature thereof were determined from Table 6 and Table 7.

The maximum value and the minimum value of $\alpha b \cdot \Delta Tb$ in a state in which each of the electrophotographic photosensitive members was installed in the above described copying machine according to the above described positional relationship were calculated from a measurement result of the temperature dependence ($\alpha b$) of the sensitivity characteristics of each of the electrophotographic photosensitive members, and a measurement result of the change ($\Delta Tb$) of the surface temperature of the electrophotographic photosensitive members before and after the images of 5,000 sheets were continuously output. The difference $\Delta(\alpha b \cdot \Delta Tb)$ between the maximum value and the minimum value is shown in Table 8.

TABLE 8

| | $\Delta(\alpha b \cdot \Delta Tb)$ |
|---|---|
| Example 2-1 | 12.3 |
| Example 2-2 | 9.3 |
| Example 2-3 | 9.5 |
| Example 2-4 | 12.6 |
| Example 2-5 | 9.8 |

Next, 5,000 sheets of images were continuously output in a low-temperature environment of a temperature of 15° C. and a relative humidity of 50% with the use of an A4 test pattern with a print rate of 1%.

(Method for Measuring Unevenness of Temperature Dependence of Sensitivity Characteristics of Electrophotographic Photosensitive Member)

An apparatus for measuring the photosensitive-member characteristics of the electrophotographic photosensitive member illustrated in FIG. 9 was used.

The electrophotographic photosensitive member 9001 was rotated in a direction of the arrow, and a pre-exposing device (not shown) of which the condition was set at predetermined conditions irradiated the surface of the electrophotographic photosensitive member 9001 with pre-exposure light 9009. Subsequently, the surface temperature of the electrophotographic photosensitive member 9001 was monitored with a temperature sensor 9013, and the heater 9010 for the electrophotographic photosensitive member was controlled so that the surface temperature became a predetermined value (hereinafter referred to as "T3"). An electric current value which was passed to a charging wire 9011 installed in the charging device 9002 was adjusted so that the potential of a dark portion in a potential sensor 9012 in a state that the surface temperature was T3 became a predetermined potential. Subsequently, the quantity of light of an image exposure beam 9003 was adjusted so that the potential of the bright portion in the potential sensor 9012 became a predetermined potential (hereinafter referred to as "V3"). Here, the potential V3 is an average value of values in one perimeter of the electrophotographic photosensitive member.

Subsequently, the heater 9010 for the electrophotographic photosensitive member was controlled so that the surface temperature of the electrophotographic photosensitive member 9001 became a predetermined value (hereinafter referred to as "T4") without changing conditions of the pre-exposing device (not shown), the charging device 9002 and the image exposure device (not shown). The potential of the bright portion in the potential sensor 9012 in a state in which the surface temperature was T4 was measured (hereinafter referred to as "V4"). Here, the potential V4 is an average value of values in one perimeter of the electrophotographic photosensitive member.

The value calculated by the following expression was determined to be the temperature dependence of the sensitivity characteristics of the electrophotographic photosensitive member.

Temperature dependence of sensitivity characteristics of electrophotographic photosensitive member=(V3−V4)/(T3−T4)

Incidentally, in the present Example, T3 was set at 25° C., T4 was set at 40° C., and V3 was set at 100 V.

The center position of the electrophotographic photosensitive member in the cylindrical shaft direction was determined to be 0 mm, measurement positions of 15 points in total at spaces of 20 mm toward both end portions therefrom were determined, and the temperature dependence of the sensitivity characteristics of the electrophotographic photosensitive member in each of the measurement positions was measured with the above described method.

The electrophotographic photosensitive member was equally divided into two regions of region H and region I in a cylindrical shaft direction, as is illustrated in FIG. 7, the measurement values of the temperature dependence of the sensitivity characteristics in each range of the region H and the region I were averaged, and the unevenness of the temperature dependence of the sensitivity characteristics of the electrophotographic photosensitive member was determined according to the absolute value of the average value. Here, the measurement value at the position of 0 mm is included in both of the region H and the region I.

Comparative Examples 2-1 to 2-5

A total of five electrophotographic photosensitive members (electrophotographic photosensitive members of Comparative Examples 2-1 to 2-5) which were manufactured respectively in a similar way to those of Examples 2-1 to 2-5 were each installed in the above described electrophotographic type of the copying machine (trade name: iR7105) which was made by Canon Inc. and was remodeled into a structure having no heater for the electrophotographic photosensitive member. At this time, a portion which had a larger absolute value of temperature dependence of the sensitivity characteristics of the electrophotographic photosensitive member was set in a side which had a larger degree of the change of the surface temperature of the electrophotographic photosensitive member before and after the images were continuously output. In addition, a portion which had a smaller absolute value of the temperature dependence of the sensitivity characteristics of the electrophotographic photosensitive member was set in a side which had a smaller degree of the change of the surface temperature of the electrophotographic photosensitive member. Incidentally, the relationships of the magnitudes of the temperature dependence of the sensitivity characteristics of the electrophotographic photosensitive member and the change of the surface temperature thereof were determined from Table 6 and Table 7, similarly to those in Examples 2-1 to 2-5.

Next, 5,000 sheets of images were continuously output in a low-temperature environment of a temperature of 15° C. and a relative humidity of 50% with the use of an A4 test pattern with a print rate of 1%.

(Evaluation of Unevenness of Image Density)

The image density was measured on the images before and after 5,000 sheets of the images were continuously output in Examples 2-1 to 2-5 and Comparative Examples 2-1 to 2-5, with a method similar to that for Examples 1-1 to 1-5, and the unevenness of image density was evaluated.

In each of the manufactured electrophotographic photosensitive members, the evaluation results were classified into the following ranks with reference to Comparative Examples. The result is shown in Table 9.

A: less than 40% with respect to Comparative Example.

B: 40% or more but less than 95% with respect to Comparative Example.

C: 95% or more but less than 105%, in other words, the same level with respect to Comparative Example.

D: 105% or more with respect to Comparative Example.

Incidentally, Example 2-1 is evaluated with reference to Comparative Example 2-1, Example 2-2 is evaluated with reference to Comparative Example 2-2, Example 2-3 is evaluated with reference to Comparative Example 2-3, Example 2-4 is evaluated with reference to Comparative Example 2-4, and Example 2-5 is evaluated with reference to Comparative Example 2-5.

As is clear from the result in Table 9, the unevenness of image density can be controlled by installing a portion which has the smaller absolute value of the temperature dependence of the sensitivity characteristics of the electrophotographic photosensitive member in a side which has a larger degree of the change of the surface temperature of the electrophotographic photosensitive member before and after the images are continuously output, and installing a portion which has the larger absolute value of the temperature dependence of the sensitivity characteristics of the electrophotographic photosensitive member in a side which shows a smaller degree of the change of the surface temperature thereof.

Examples 3-1 to 3-3

The surfaces (peripheral surface) of cylindrical bodies made from aluminum with a length of 358 mm were subjected to a mirror finishing process with the use of a lathe, and a total of three cylindrical substrates with the length of 358 mm and an outer diameter of 80 mm were produced.

Subsequently, deposition films of a charge injection blocking layer, a first photoconductive layer, a second photoconductive layer, an intermediate layer and a surface layer were formed in this order on the cylindrical substrates, respectively, with a method similar to that for Examples 1-1 to 1-5 except for the number of electrophotographic photosensitive members, and thereby a total of three electrophotographic photosensitive members were manufactured. These electrophotographic photosensitive members shall be named as electrophotographic photosensitive members of Examples 3-1 to 3-3.

Figure 8C:
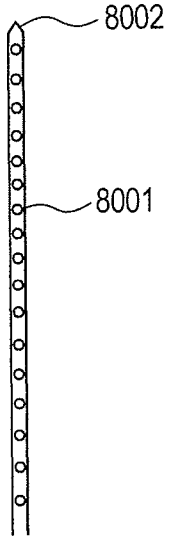
Figure 8D:
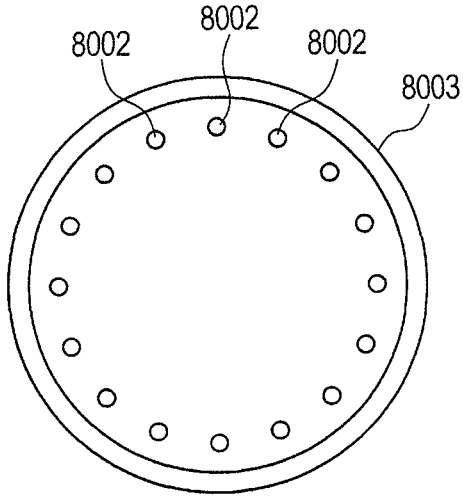

Incidentally, in the present Example, a gas pipe 8002 having gas blowing holes 8001 distributed therein as illustrated in FIG. 8C was used as a gas pipe 5005 illustrated in FIG. 5, and sixteen gas pipes 8002 were arranged in the inner part of the reaction vessel 8003 as illustrated in FIG. 8D.

In addition, as a result of having adjusted the unevenness of the temperature dependence of the photosensitive-member characteristics of the manufactured electrophotographic photosensitive member, the distribution of the gas blowing holes 8001 of the gas pipe 8002, which existed in the upper side of the reaction vessel 5000, was uneven as illustrated in FIG. 8C.

Subsequently, the temperature dependence ($\alpha a$) of the charging characteristics of each of the manufactured electrophotographic photosensitive members was measured with a method similar to that for Examples 1-1 to 1-5, and the unevenness of the temperature dependence of the charging characteristics of the electrophotographic photosensitive member was determined. The result is shown in Table 10 with the result of after-mentioned comparative examples 3-1 to 3-3. The values of the unevenness of the temperature dependence of the charging characteristics of the electrophotographic photosensitive members were different among each of the electrophotographic photosensitive members due to the variation in manufacture.

TABLE 9

| | Unevenness of image density |
|---|---|
| Example 2-1 | B |
| Example 2-2 | B |
| Example 2-3 | B |
| Example 2-4 | B |
| Example 2-5 | B |

TABLE 10

| Absolute value of temperature dependence of charging characteristics of electrophotographic photosensitive member (V/° C.) | Region H | Region I |
|---|---|---|
| Example 3-1 | 2.4 | 1.7 |
| Example 3-2 | 2.2 | 1.5 |
| Example 3-3 | 2.1 | 1.5 |

TABLE 10-continued

| Absolute value of temperature dependence of charging characteristics of electrophotographic photosensitive member (V/° C.) | Region H | Region I |
|---|---|---|
| Comparative Examples 3-1 | 2.4 | 1.6 |
| Comparative Examples 3-2 | 2.0 | 1.3 |
| Comparative Examples 3-3 | 2.1 | 1.4 |

Incidentally, the shape of the unevenness of the temperature dependence of the charging characteristics of each of the electrophotographic photosensitive members was a shape which had no inflection point and monotonously changed, as illustrated in FIG. 6C.

In addition, in the present Example, the airflow structure illustrated in FIGS. 4A and 4B was adopted similarly to that in Examples 1-1 to 1-5.

Subsequently, each of the manufactured electrophotographic photosensitive members were each installed in an electrophotographic type of a copying machine (trade name: iR5075) which was made by Canon Inc. and was remodeled into the structure having no heater for the electrophotographic photosensitive member. At this time, a portion which had a smaller absolute value of the temperature dependence of the charging characteristics of the electrophotographic photosensitive member was set in a side which had a larger degree of the change of the surface temperature of the electrophotographic photosensitive member before and after the images were continuously output. In addition, a portion which had a larger absolute value of the temperature dependence of the charging characteristics of the electrophotographic photosensitive member was set on a side which had a smaller degree of the change of the surface temperature of the electrophotographic photosensitive member. Incidentally, the relationships of the magnitudes of the temperature dependence of the charging characteristics of the electrophotographic photosensitive member and the change of the surface temperature thereof were determined from Table 10 and Table 3.

The maximum value and the minimum value of $\alpha a \cdot \Delta Ta$ were calculated in the state in which each electrophotographic photosensitive member was installed in the above described copying machine according to the above described positional relationship, similarly to those in Examples 1-1 to 1-5. The difference $\Delta(\alpha a \cdot \Delta Ta)$ between the maximum value and the minimum value is shown in Table 11.

TABLE 11

| | $\Delta(\alpha a \cdot \Delta Ta)$ |
|---|---|
| Example 3-1 | 16.4 |
| Example 3-2 | 15.1 |
| Example 3-3 | 13.8 |

Next, 5,000 sheets of images were continuously output in a low-temperature environment of a temperature of 15° C. and a relative humidity of 50% with the use of an A4 test pattern with a print rate of 1%.

Comparative Examples 3-1 to 3-3

A total of three electrophotographic photosensitive members (electrophotographic photosensitive members of Comparative Examples 3-1 to 3-3) which were manufactured respectively in a similar way to that for Examples 3-1 to 3-3 were each installed in the above described electrophotographic type of the copying machine (trade name: iR5075) which was made by Canon Inc. and was remodeled into a structure having no heater for the electrophotographic photosensitive member. At this time, a portion which had a larger absolute value of a temperature dependence of the charging characteristics of the electrophotographic photosensitive member was set in a side which had a larger degree of the change of the surface temperature of the electrophotographic photosensitive member before and after the images were continuously output. In addition, a portion which had a smaller absolute value of the temperature dependence of the charging characteristics of the electrophotographic photosensitive member was set in a side which had a smaller degree of the change of the surface temperature of the electrophotographic photosensitive member. Incidentally, the relationships of the magnitudes of the temperature dependence of the charging characteristics of the electrophotographic photosensitive member and the change of the surface temperature thereof were determined from Table 10 and Table 3, similarly to those in Examples 3-1 to 3-3.

Next, 5,000 sheets of images were continuously output in a low-temperature environment of a temperature of 15° C. and a relative humidity of 50% with the use of an A4 test pattern with a print rate of 1%.

(Evaluation of Unevenness of Image Density)

The image density was measured on the images before and after 5,000 sheets of the images were continuously output in Examples 3-1 to 3-3 and Comparative Examples 3-1 to 3-3, with a method similar to that for Examples 1-1 to 1-5, and the unevenness of image density was evaluated.

In each of the manufactured electrophotographic photosensitive members, the evaluation results were classified into the following ranks with reference to Comparative Examples. The results are shown in Table 12.

A: less than 40% with respect to Comparative Example.

B: 40% or more but less than 95% with respect to Comparative Example.

C: 95% or more but less than 105%, in other words, the same level with respect to Comparative Example.

D: 105% or more with respect to Comparative Example.

For information, Example 3-1 is evaluated with reference to Comparative Example 3-1, Example 3-2 is evaluated with reference to Comparative Example 3-2 and Example 3-3 is evaluated with reference to Comparative Example 3-3.

TABLE 12

| | Unevenness of image density |
|---|---|
| Example 3-1 | A |
| Example 3-2 | A |
| Example 3-3 | A |

As is clear from the result in Table 12, a more remarkable effect of the present invention can be obtained due to the monotonous increase or decrease of the temperature dependence of the photosensitive-member characteristics (charging characteristics) of the electrophotographic photosensitive member and the change of the surface temperature thereof, in the direction of the cylindrical shaft (rotary shaft direction) of the electrophotographic photosensitive member.

While the present invention has been described with reference to Examples, it is to be understood that the invention is not limited to the disclosed Examples. The scope of the following claims is to be accorded the broadest interpretation so as to encompass all such modifications and equivalent structures and functions.

This application claims the benefit of Japanese Patent Applications No. 2011-212632, filed Sep. 28, 2011, and No. 2012-206001, Sep. 19, 2012, which are hereby incorporated by reference herein in their entirety.

What is claimed is:

1. An electrophotographic apparatus comprising:

a cylindrical electrophotographic photosensitive member having a photoconductive layer formed from amorphous silicon;

a charging device for charging a surface of the electrophotographic photosensitive member; and an image exposure device for irradiating the surface of the electrophotographic photosensitive member with an image exposure beam to form an electrostatic latent image on the surface of the electrophotographic photosensitive member with the electrophotographic apparatus having no unit for maintaining a uniform surface temperature of the electrophotographic photosensitive member throughout its surface, wherein, the electrophotographic photosensitive member has such a temperature dependence of photosensitive-member characteristics that the photosensitive-member characteristics vary depending on the surface temperature, when the electrophotographic photosensitive member is equally divided into two regions in a cylindrical shaft direction, absolute values of the temperature dependence of the photosensitive-member characteristics in the two regions are not the same, and the electrophotographic photosensitive member is arranged in the electrophotographic apparatus, so that, when among the two regions, a region which has a smaller absolute value of the temperature dependence of the photosensitive-member characteristics is defined as a first region, and a region which has a larger absolute value of the temperature dependence of the photosensitive-member characteristics is defined as a second region, the change of the surface temperature of the first region becomes larger than the change of the surface temperature of the second region when an image is formed by the electrophotographic apparatus.

2. The electrophotographic apparatus according to claim 1, wherein when the temperature dependence of the photosensitive-member characteristics in a certain portion of the electrophotographic photosensitive member is expressed by $\alpha$ [V/° C.] and the change of the surface temperature there is expressed by $\Delta T$ [° C.], a difference $\Delta(\alpha \cdot \Delta T)$ between a value of $\alpha \cdot \Delta T$ in a portion at which the value of $\alpha \cdot \Delta T$ that is a product of $\alpha$ and $\Delta T$ becomes maximal and the value of $\alpha \cdot \Delta T$ in a portion at which the value of $\alpha \cdot \Delta T$ becomes minimal can satisfy a relationship between the $\Delta(\alpha \cdot \Delta T)$ and a latent image contrast potential Vc [V] that is defined by a difference between a potential in a portion that has been irradiated with an image exposure beam on the surface of the electrophotographic photosensitive member when an image is formed and a potential in a portion that has not been irradiated with the image exposure beam on the surface of the electrophotographic photosensitive member at the time, which is expressed by the following expression:

$$\Delta(\alpha \cdot \Delta T) \leq 0.07 \cdot Vc.$$

3. The electrophotographic apparatus according to claim 1, wherein a degree of the temperature dependence of the photosensitive-member characteristics of the electrophotographic photosensitive member monotonously increases from one end side toward the other end side in the cylindrical shaft direction of the electrophotographic photosensitive member, and the degree of the change of the surface temperature of the electrophotographic photosensitive member when the image is formed by the electrophotographic apparatus monotonously decreases from one end side toward the other end side in the cylindrical shaft direction of the electrophotographic photosensitive member.

4. The electrophotographic apparatus according to claim 1, wherein the charging device is arranged so as to be approximately parallel to a cylindrical shaft direction of the electrophotographic photosensitive member, and further comprising an air supply device for supplying air from one end side of a longitudinal direction of the charging device into the charging device, or an exhaust device for discharging air in the charging device from the one end side of the longitudinal direction of the charging device.

5. The electrophotographic apparatus according to claim 1, wherein the electrophotographic apparatus is an electrophotographic apparatus of a background area exposure, BAE, system, and the photosensitive-member characteristics are charging characteristics of the electrophotographic photosensitive member.

6. The electrophotographic apparatus according to claim 1, wherein the electrophotographic apparatus is an electrophotographic apparatus of an image area exposure, IAE, system, and the photosensitive-member characteristics are sensitivity characteristics of the electrophotographic photosensitive member.

* * * * *